US010519001B2

(12) United States Patent
Liu

(10) Patent No.: US 10,519,001 B2
(45) Date of Patent: Dec. 31, 2019

(54) HOSE-REELING APPARATUS

(71) Applicant: Aifa Hangzhou Lawn and Garden Acc., Co. LTD, Hangzhou, Zhejiang (CN)

(72) Inventor: Hong-Bin Liu, Hangzhou (CN)

(73) Assignee: Aifa Hangzhou Lawn and Garden Acc., Co. Ltd., Zhejiang (CN)

( * ) Notice: Subject to any disclaimer, the term of this patent is extended or adjusted under 35 U.S.C. 154(b) by 7 days.

(21) Appl. No.: 15/921,769

(22) Filed: Mar. 15, 2018

(65) Prior Publication Data

US 2019/0284017 A1 Sep. 19, 2019

(51) Int. Cl.
*B65H 75/44* (2006.01)
*B65H 75/40* (2006.01)

(52) U.S. Cl.
CPC ..... *B65H 75/4463* (2013.01); *B65H 75/403* (2013.01); *B65H 75/4471* (2013.01); *B65H 2701/33* (2013.01); *Y10T 137/6958* (2015.04)

(58) Field of Classification Search
CPC ..... B65H 75/4463; B65H 75/403; B65H 75/4471; B65H 75/4407; Y10T 137/6899–6962
See application file for complete search history.

(56) References Cited

U.S. PATENT DOCUMENTS 3,841,631 A * 10/1974 Dolan ..... A63B 71/023 108/15
5,179,972 A * 1/1993 Eley ..... B65H 75/38 137/355.19
5,220,740 A * 6/1993 Brault ..... F16M 11/42 248/910
6,742,740 B2 * 6/2004 Tisbo ..... B65H 75/40 137/355.26
7,857,000 B1 * 12/2010 Langdon ..... B65H 75/38 137/355.27
8,096,317 B2 * 1/2012 Uffner ..... B65H 75/40 137/355.12
8,317,121 B2 * 11/2012 Tracey ..... B65H 75/4471 137/355.26
10,087,041 B1 * 10/2018 Langdon ..... B65H 75/4471

* cited by examiner

*Primary Examiner* — Kevin F Murphy
(74) *Attorney, Agent, or Firm* — Alan D. Kamrath; Mayer & Williams PC

(57) ABSTRACT

A hose-reeling apparatus includes a base unit, a support unit, a joint unit and a reel unit. The base unit includes two casters provided thereon. The support unit includes a hollow post supported on the base unit and a sleeve provided on the hollow post. The joint unit includes a lower joint connected to the hollow post, a tubular plug inserted in an upper end of the hollow post, and an upper joint comprising a lower portion inserted in the tubular plug and an upper portion inserted in the shell. The reel unit includes a shell, a hollow reel, a crank, an outlet joint, a track, a driving rod, a sliding element, a transmission unit, a lower tube, and an upper tube.

13 Claims, 8 Drawing Sheets

HOSE-REELING APPARATUS

BACKGROUND OF INVENTION

1. Field of Invention

The present invention relates to a hose used in gardening and, more particularly, to a hose-reeling apparatus.

2. Related Prior Art

A conventional hose-reeling apparatus includes a stand, a reel supported on the stand and a crank connected to the reel. A hose is wound onto or unwound from the reel by operating the crank. However, the stand is short and located close to the ground. A user has to bend over or squat down to operate the crank, and such poses are inconvenient and unhealthy for the user. Moreover, the stand is not equipped with any caster. The user is forced to wind at least a portion of the hose onto the reel before he or she moves the hose and the hose-reeling apparatus to another place lest the hose would get tangled.

The present invention is therefore intended to obviate or at least alleviate the problems encountered in prior art.

SUMMARY OF INVENTION

It is the primary objective of the present invention to provide a convenient hose-reeling apparatus.

To achieve the foregoing objective, the hose-reeling apparatus includes a base unit, a support unit, a joint unit, a reel unit, a lower tube and an upper tube. The base unit includes two casters provided thereon. The support unit includes a hollow post supported on the base unit and a sleeve rotationally provided on the hollow post. The joint unit includes a lower joint connected to the hollow post, a tubular plug inserted in an upper end of the hollow post, and an upper joint comprising a lower portion inserted in the tubular plug and an upper portion inserted in the shell. The reel unit includes a shell, a hollow reel, a crank, an outlet joint, a track, a driving rod, a sliding element and a transmission unit. The shell is supported on the sleeve, receives the upper portion of the upper joint, and includes a slot for receiving a portion of an outlet hose. The hollow reel is inserted in the shell and used for reeling the outlet hose. The crank includes an internal end connected to the hollow reel and an external end located out of the shell. The outlet joint includes a first end connected to the hollow reel and a second end connected to the outlet hose. The guiding and driving rods are inserted in the shell. The sliding element is movable along the driving rod by the driving rod and formed with an aperture for receiving a portion of the outlet hose. The slot is made of a length determined according to a stroke of movement of the sliding element along the track. The transmission unit connects the driving rod to the hollow reel so that the sliding element moves the outlet hose while the hollow reel winds the outlet hose. Thus, the outlet hose is neatly wound. The lower tube connects the lower joint to the tubular plug. The upper tube connects the upper joint to the outlet joint.

Advantageously, the reel unit is located at a proper height by the support unit to allow a user to operate the reel unit to wind the outlet hose comfortably.

Advantageously, the sleeve allows the reel unit to spin relative to the support unit.

Advantageously, the reel unit winds the outlet hose neatly without any risk of the outlet hose getting tangled.

In another aspect, the carrier comprises a frame for supporting the box and two casters connected to the frame.

The box comprises a slope formed on a lower portion thereof and located between the casters. To move the hose-reeling apparatus, the base unit is tilted forward to bring the casters into contact with the ground. The slope keeps the box from the ground.

In another aspect, the base unit includes a box for containing sand or water. Filled with the sand or water, the box is used as a weight to keep the hose-reeling apparatus film on the ground. The water or sand can be released from the chamber. Without any sand or water in the box, the hose-reeling apparatus can easily be moved around, transported and stored.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
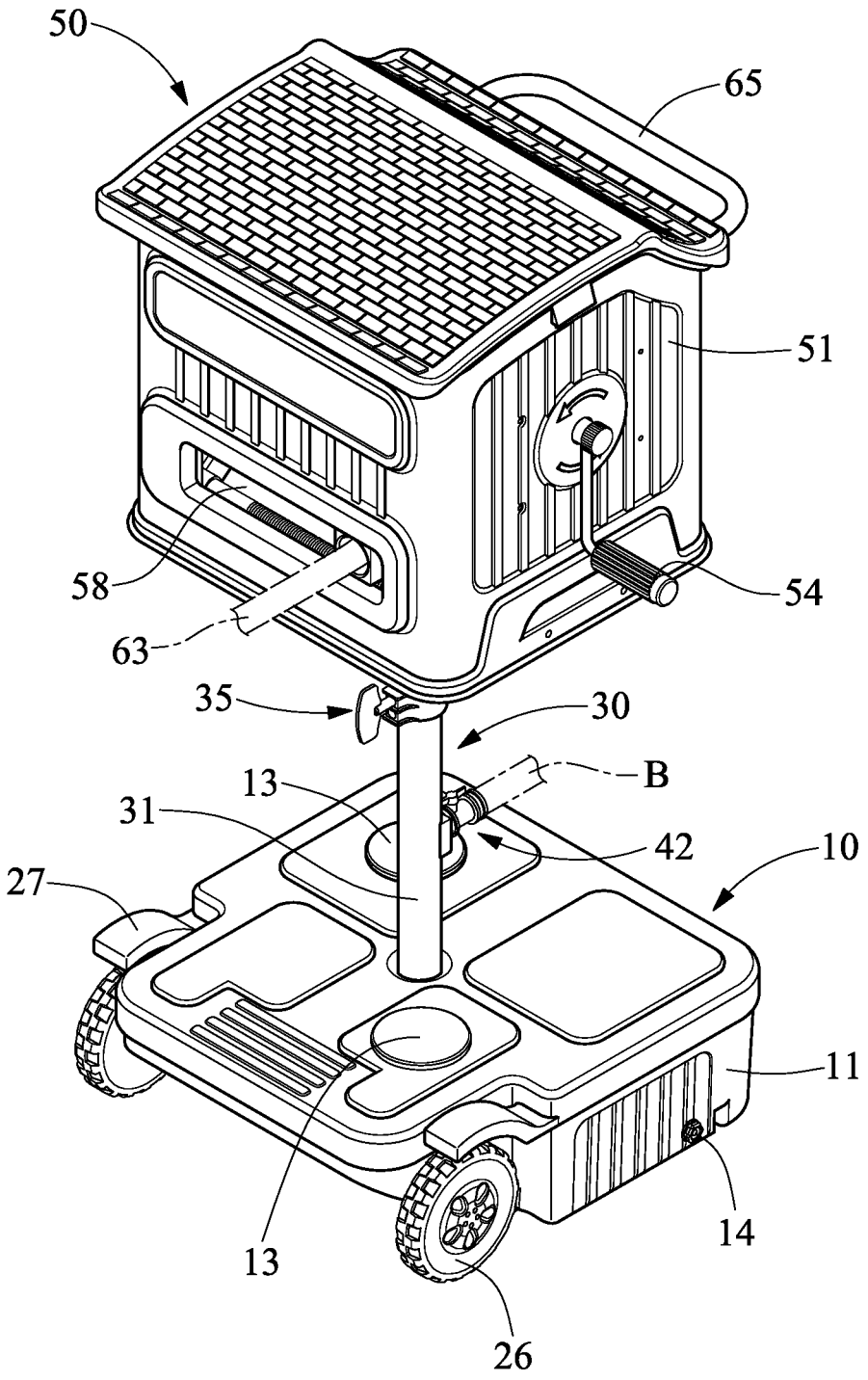
FIG. 1 is a perspective view of a hose-reeling apparatus according to the preferred embodiment of the present invention.

Referring to FIGS. 1 to 8, a hose-reeling apparatus comprises a base unit 10, a support unit 30, a joint unit 40 and a reel unit 50 according to the preferred embodiment of the present invention. The base unit 10 includes a box 11 and a carrier 20. The reel unit 50 includes a shell 51 for containing other elements to be described.

Referring to FIGS. 1 to 4, the box 11 is made with an upper portion, a lower portion opposite the upper portion and a lateral portion between the upper and lower portions thereof. The box 11 includes a chamber 12, an inlet 13, an outlet 14 and a tunnel 17. The inlet 13 is made in the upper portion of the box 11. The outlet 14 is made in the lateral portion of the box 11. The inlet 13 and the outlet 14 are in communication with the chamber 12.

In use, sand or water can be filled in the chamber 12 through the inlet 13. Filled with the sand or water, the box 11 is used as a weight to keep the hose-reeling apparatus film on the ground. The water or sand can be released from the chamber 12 via the outlet 14. Without any sand or water in the chamber 12, the hose-reeling apparatus can easily be moved around, transported and stored.

The tunnel 17 extends throughout the box 11, i.e., from the upper portion of the box 11 to the lower portion of the box 11. The tunnel 17 is separated from the chamber 12.

Figure 2:
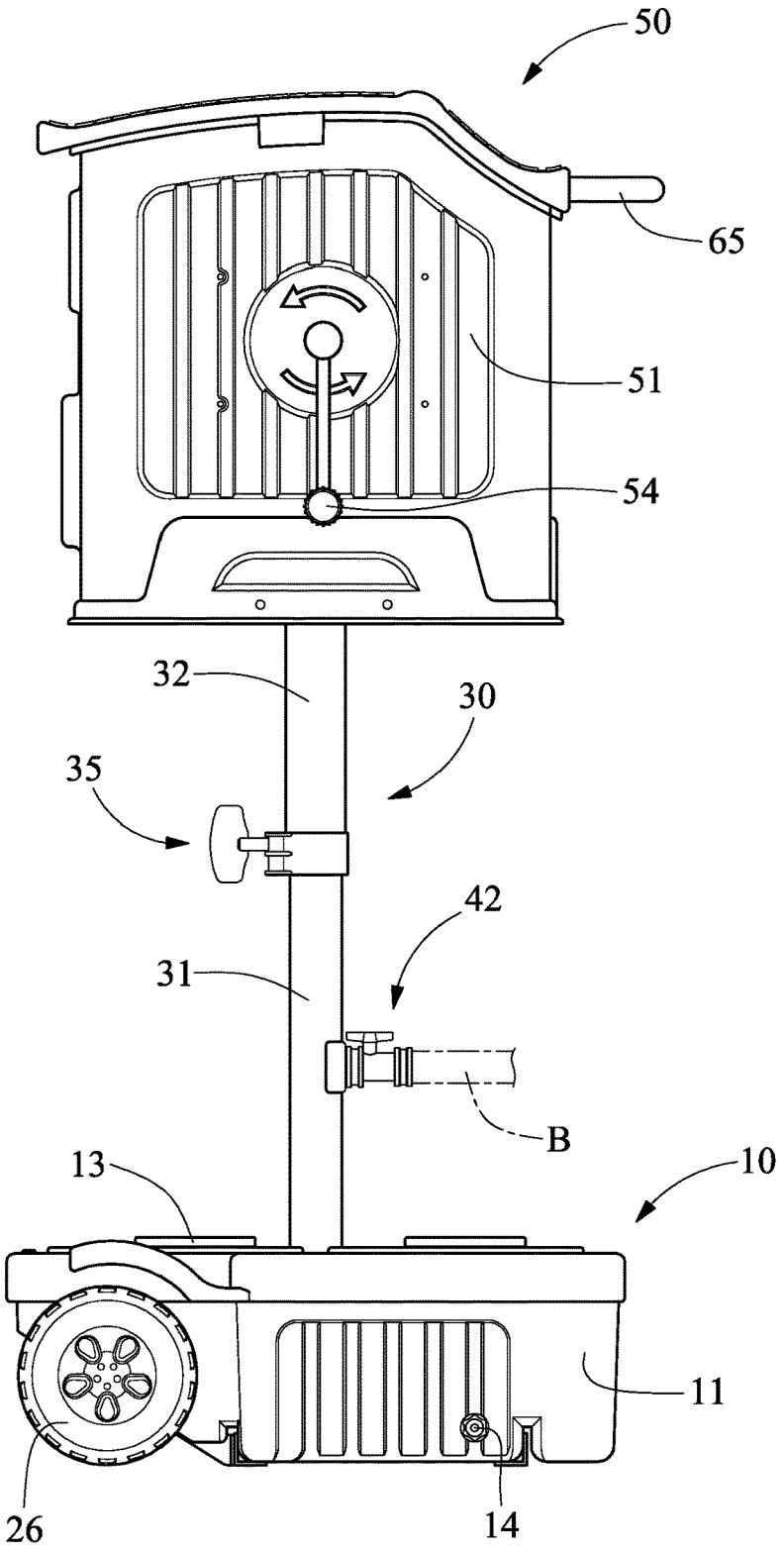
FIG. 2 is a side view of the hose-reeling apparatus shown in FIG. 1.
Figure 3:
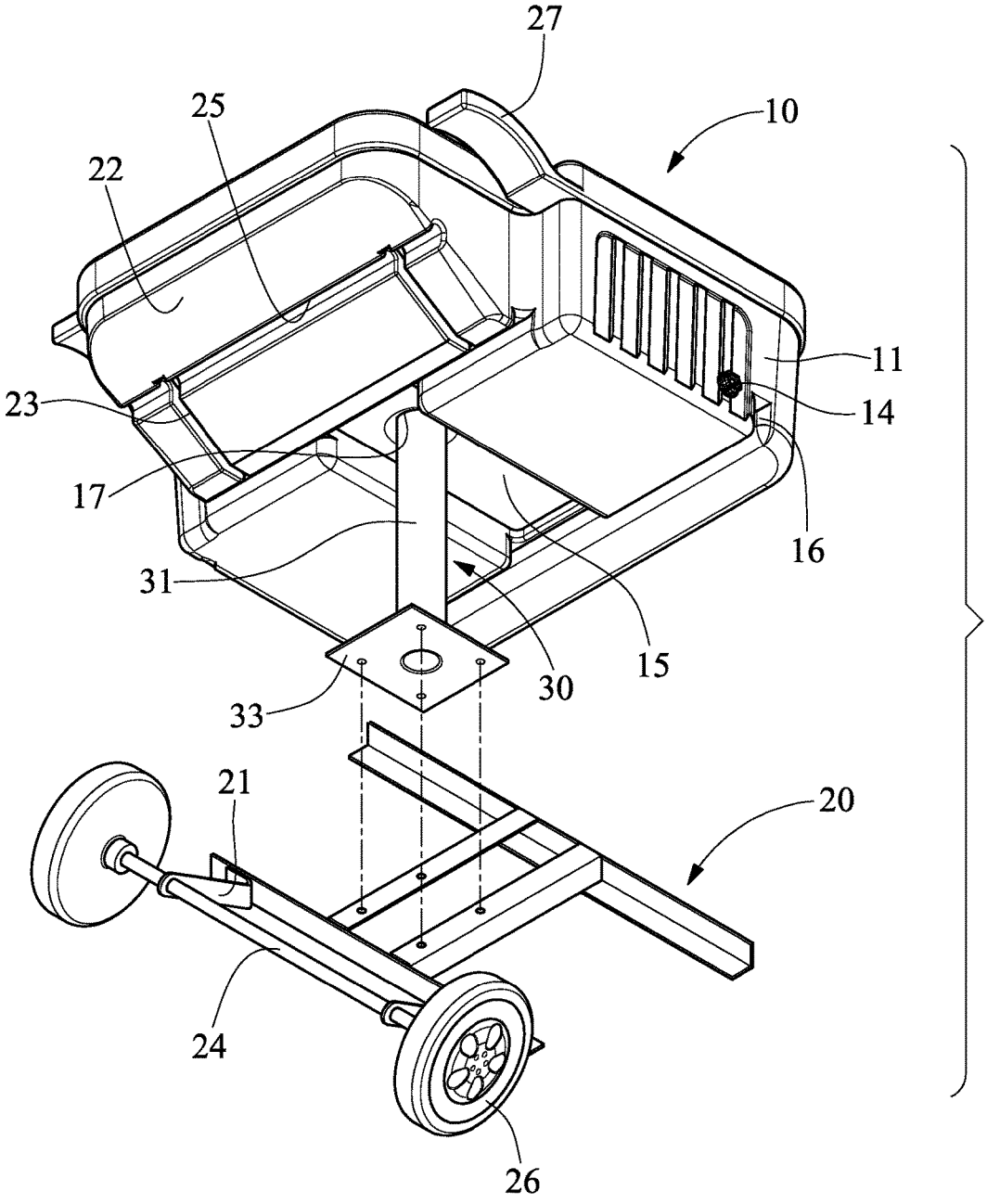
FIG. 3 is an exploded view of a base unit of the hose-reeling apparatus shown in FIG. 1.
Figure 4:
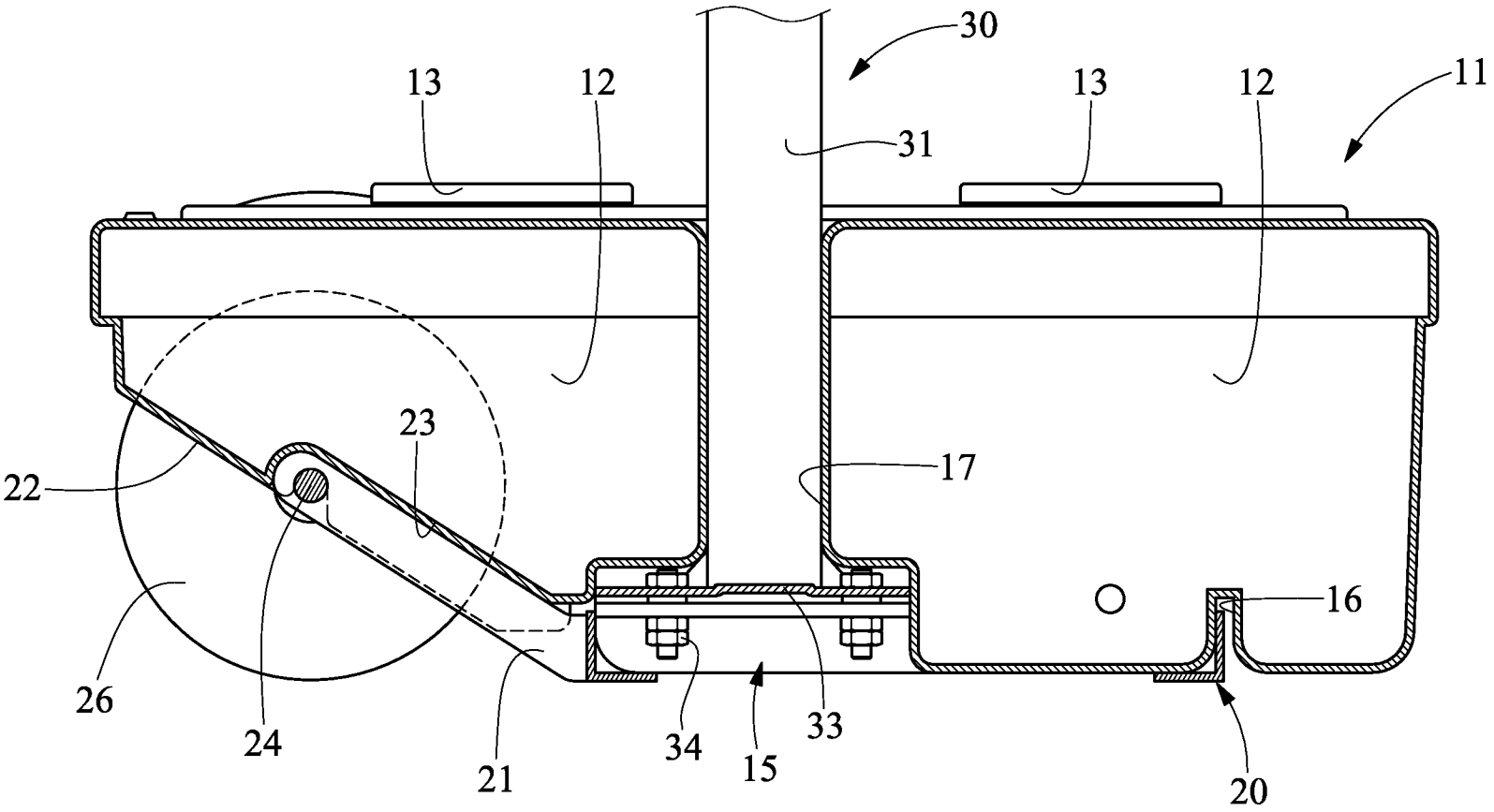
FIG. 4 is a cross-sectional view of the base unit shown in FIG. 1.
Figure 5:
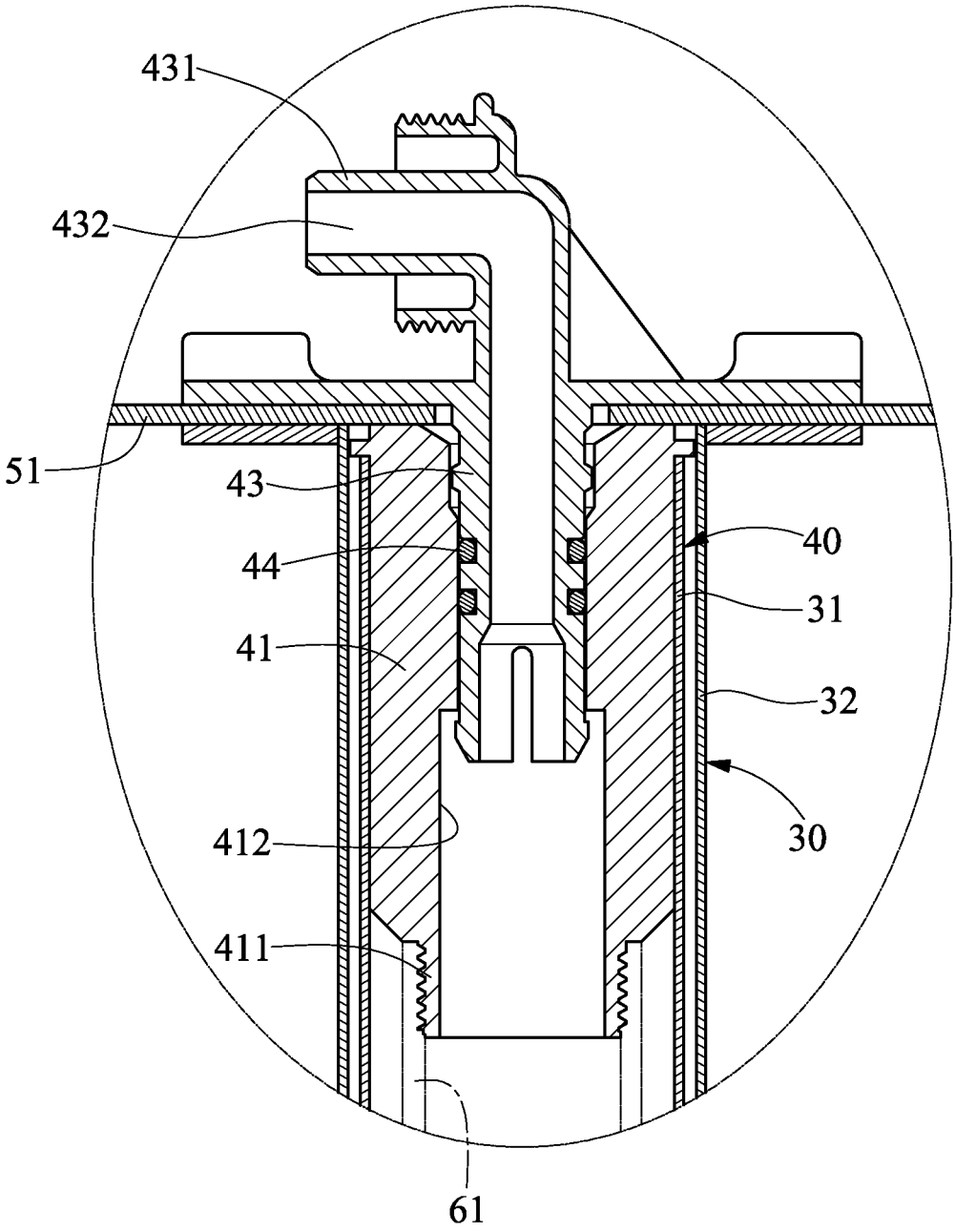
FIG. 5 is a cross-sectional view of a support unit of the hose-reeling apparatus shown in FIG. 1.

Referring to FIG. 2, the box 11 further includes a middle recess 15 and a rear recess 16 in the lower portion thereof. The lower portion of the box 11 is made with a slope 22. The slope 22 is made with two inclined beam-receiving recesses 23 and an axle-receiving recess 25.

The box 11 further includes two mudguards 27. Each of the mudguards 27 extends in an arched manner. The slope 22 is located between the mudguards 27.

The carrier 20 includes two casters 26 connected to a frame 28. The frame 28 is made of metal for example and includes a front portion, a rear portion and a middle portion formed between the front and rear portions thereof. The frame 28 includes two inclined beams 21 extending from the front portion thereof. An axle 24 is connected to the inclined beams 21. The casters 26 are connected to the axle 24.

Referring to FIGS. 1, 2, 5 and 6, the support unit 30 includes a hollow post 31, a sleeve 32 and a plate 33. The hollow post 31, the sleeve 32 and the plate 33 are made of metal for example. The hollow post 31 includes a lower end supported on and connected to the plate 33. The sleeve 32 is rotationally located on an upper portion of the hollow post 31. A locking element 35 is located on the sleeve 32. The locking element 35 is switchable between a locking position and an unlocking position. In the locking position, the locking element 35 keeps the sleeve 32 in position relative to the hollow post 31. In the unlocking position, the locking element 35 allows the sleeve 32 to rotate relative to the hollow post 31.

In assembly, the plate 33 is connected to the middle portion of the carrier 20 by screws 34. The hollow post 31 is inserted in the tunnel 17, i.e., the box 11 is provided around the hollow post 31. The shell 51 is connected to the sleeve 32 so that they are not rotatable relative to each other. The lower portion of the box 11 is located on and connected to the frame 28. Thus, the box 11, which is made of plastics, is reinforced by the frame 28, which I made of metal. The middle portion of the frame 28 is inserted in the middle recess 15 of the box 11. The rear portion of the frame 28 is inserted in the rear recess 16 of the box 11. The inclined beams 21 are inserted in the beam-receiving recesses 23. The axle 24 is inserted in the axle-receiving recess 25. The mudguards 27 are located above and hence shield the casters 26.

To move the hose-reeling apparatus, the hose-reeling apparatus is tilted forward. Accordingly, the base unit 10 is tilted forward so that the casters 26 are brought into contact with the ground. The casters 26 can be rolled to move the hose-reeling apparatus. The slope 22 keeps the lower portion of the box 11 from the ground to ensure smooth movement of the hose-reeling apparatus. The mudguards 27 keep the box 11 from mud or dirt.

In the locking position, the locking element 35 retains the shell 51, which is connected to the sleeve 32, in position relative to the hollow post 31. In the unlocking position, the locking element 35 allows the shell 51 to rotate relative to the hollow post 31.

Referring to FIGS. 1, 2 5 and 6, the joint unit 40 includes a tubular plug 41, a lower joint 42 and an upper joint 43. The tubular plug 41 includes a lower end, an upper end and a channel 412 extending to the upper end thereof from the lower end thereof. The lower end of the tubular plug 41 is formed with a hose-connecting portion 411 that includes a thread or annular ribs formed on an external face thereof. The lower joint 42 includes an internal end inserted in the hollow post 31 and an external end located out of the hollow post 31. The tubular plug 41 is inserted in an upper end of the hollow post 31. The upper joint 43 includes a lower end, an upper end and an axial channel 432 extending to the upper end thereof from the lower end thereof. The lower end of the upper joint 43 is inserted in the tubular plug 41. The upper end of the upper joint 43 is formed with a hose-connecting portion 431 inserted in the shell 51.

Figure 7:
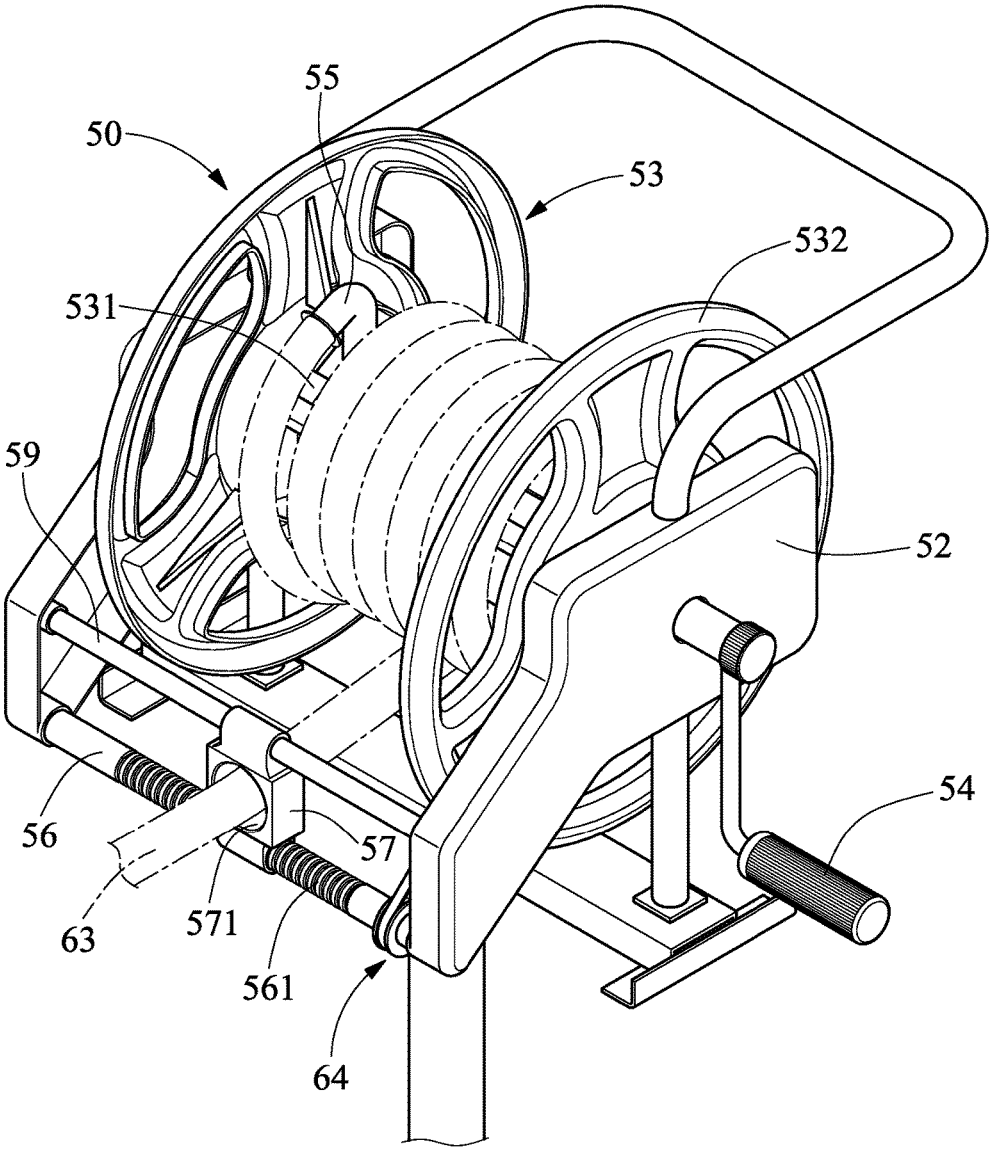
FIG. 7 is a perspective view of a reel unit of the hose-reeling apparatus shown in FIG. 1.
Figure 8:
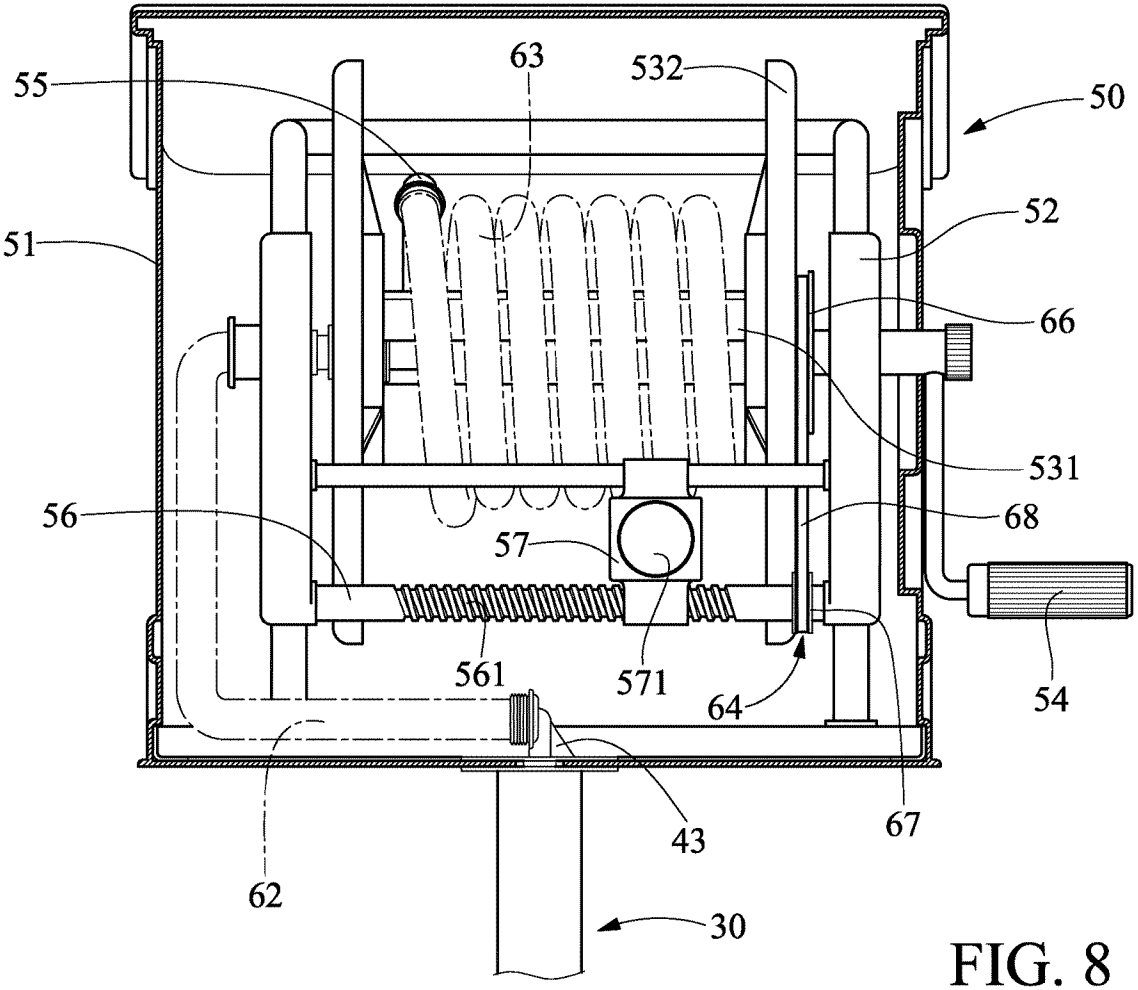
FIG. 8 is a cross-sectional view of a shell that contains reel unit shown in FIG. 7.

Referring to FIGS. 7 and 8, in addition to the shell 51, the reel unit 50 includes a positioning element 52, a hollow reel 53, a crank 54, a track 59, a driving rod 56 and a sliding element 57. The shell 51 is made with a slot 58 and a handle 65 (FIG. 1). The handle 65 is operable to move the hose-reeling apparatus.

The positioning element 52, the hollow reel 53, the track 59, the driving rod 56 and the sliding element 57 are inserted in the shell 51. The positioning element 52 is connected to an internal portion of the shell 51. The hollow reel 53 is supported on the positioning element 52. The hollow reel 53 includes a reeling portion 531 formed between two wheels 532. The crank 54 includes an internal end connected to the reeling portion 531 of the hollow reel 53 and an external end provided with a grip (not numbered) located out of the shell the shell 51. The guiding element 59 and the driving rod 56 are connected to the positioning element 52.

A transmission unit 64 is used to operatively connect the driving rod 56 to the hollow reel 53. The transmission unit 64 includes two pulleys 66 and 67 and a belt 68. The pulley 66 is connected to the reel 53 so that they are rotatable together. The pulley 67 is connected to the driving rod 56 so that they are rotatable together. The belt 68 is in the form of a loop provided on the pulleys 66 and 67. The driving rod 56 is formed with a thread 561. The sliding element 57 includes a tunnel (not numbered) for receiving the track 59 and a screw hole (not numbered) for receiving the thread 561 of the driving rod 56. The length of the slot 58 is determined according to a stroke of movement of the sliding element 57 along the driving rod 56 and the track 59. The sliding element 57 further includes an aperture 571 to be described.

The outlet joint 55 includes an end connected to the reeling portion 531 of the hollow reel 53 near one of the wheels 532 and another end inserted in an internal end of an outlet hose 63. An external end of the outlet hose 63 is moved out of the shell 51 through the slot 58. A portion of the outlet hose 63 is inserted in the aperture 571.

Figure 6:
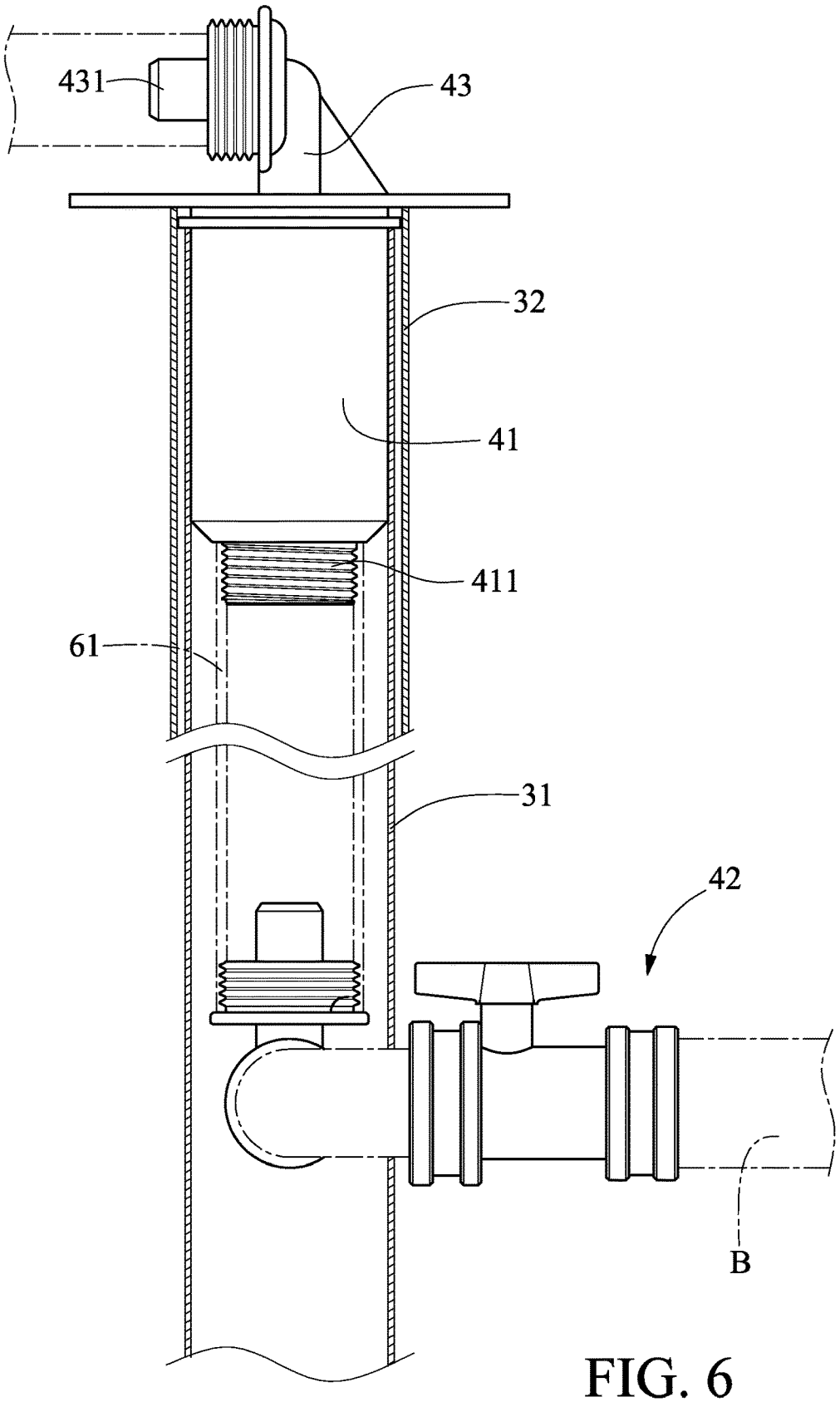
FIG. 6 is another cross-sectional view of the support unit of FIG. 5.

An end of an inlet hose B is connected to a faucet (not shown). The external end of the lower joint 42 is inserted in another end of the inlet hose B. The internal end of the lower joint 42 is inserted in a lower end of a lower tube 61. The hose-connecting portion 411 of the tubular plug 41 is inserted in an upper end of the lower tube 61. The hose-connecting portion 431 of the upper joint 43 is inserted in a first end of an upper tube 62 inserted in the shell 51 (FIG. 6). A second end of the upper tube 62 is connected to the reeling portion 531 of the hollow reel 53. There are sealing rings 44 provided between the tubular plug 41 and the upper joint 43 to avoid leak of water via a gap between the tubular plug 41 and the upper joint 43.

That is, the inlet hose B is connected to the lower tube 61 through the lower joint 42. The lower tube 61 is connected to the upper tube 62 via the tubular plug 41 and the upper joint 43. The upper tube 62 is connected to the outlet hose 63 through the reeling portion 531 of the hollow reel 53 and the outlet joint 55. Thus, water can be sent onto the ground, a plant or any other proper object from the faucet via the hoses 61 and B and the tubes 61 and 62.

The crank 54 is operable to spin the hollow reel 53 to wound the outlet hose 63. Synchronously, the hollow reel 53 causes the driving rod 56 to spin via the transmission unit 64. Thus, the sliding element 57 moves along the driving rod 56 and the track 59 to move the outlet hose 63 so that the outlet hose 63 is neatly wound on the reeling portion 531 of the hollow reel 53 without any risk of getting tangled.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hose-reeling apparatus comprising:

a base unit comprising:

a box for containing a weight-increasing material to increase the weight of the hose-reeling apparatus, wherein the box comprises a slope formed on a lower portion thereof;

a carrier comprising:

a frame for supporting the box, wherein the frame comprises two inclined beams extending substantially parallel to the slope and an axle supported on the inclined beams; and two wheels connected to the axle and located on two opposite sides of the slope of the box;

a support unit comprising:

a hollow post supported on the base unit;

a sleeve rotationally provided on the hollow post;

a joint unit comprising:

a lower joint connected to the hollow post;

a tubular plug inserted in an upper end of the hollow post;

an upper joint comprising a lower portion inserted in the tubular plug and an upper portion;

a reel unit comprising:

a shell supported on the sleeve and made with a slot for receiving a portion of an outlet hose, wherein the upper portion of the upper joint is inserted in the shell;

a hollow reel inserted in the shell and used to reel the outlet hose;

a crank comprising an internal end connected to the hollow reel and an external end located out of the shell;

an outlet joint comprising a first end connected to the hollow reel and a second end connected to the outlet hose;

a driving rod inserted in the shell;

a sliding element movable by the driving rod and formed with an aperture for receiving a portion of the outlet hose, wherein the slot is made of a length determined according to a stroke of movement of the sliding element; and a transmission unit for connecting the driving rod to the hollow reel so that the sliding element moves the outlet hose while the hollow reel winds the outlet hose, thereby neatly winding the outlet hose;

a lower tube for connecting the lower joint to the tubular plug; and an upper tube for connecting the upper joint to the outlet joint.

2. The hose-reeling apparatus according to claim 1, wherein the box comprises a chamber for containing the weight-increasing material and a tunnel for receiving the hollow post, wherein the tunnel is separated from the chamber.

3. The hose-reeling apparatus according to claim 1, wherein the support unit further comprises a plate formed at a lower end of the hollow post and connected to the frame.

4. The hose-reeling apparatus according to claim 3, wherein the box comprises at least one recess for receiving the plate and the frame.

5. The hose-reeling apparatus according to claim 1, wherein the slope comprises two inclined beam-receiving recesses for receiving the inclined beams.

6. The hose-reeling apparatus according to claim 1, wherein the box comprises two mudguards located above the wheels.

7. The hose-reeling apparatus according to claim 1, wherein the support unit further comprises a locking element movable between a locking position for keeping the sleeve in position relative to the hollow post and an unlocking position for allowing the sleeve to spin relative to the hollow post.

8. The hose-reeling apparatus according to claim 1, wherein the joint unit further comprises at least one sealing ring between the tubular plug and the upper joint.

9. The hose-reeling apparatus according to claim 1, wherein the transmission unit comprising:

a pulley connected to the reel so that they are rotatable together;

a pulley connected to the driving rod so that they are rotatable together; and a belt provided on the pulleys.

10. The hose-reeling apparatus according to claim 1, wherein the reel unit further comprises a handle connected to the shell.

11. The hose-reeling apparatus according to claim 1, wherein the lower joint comprises an external end for insertion in an inlet hose outside the hollow post and an internal end inserted in the lower tube in the hollow post.

12. The hose-reeling apparatus according to claim 1, wherein the reel unit further comprises a track for guiding the sliding element in movement.

13. The hose-reeling apparatus according to claim 12, wherein the track is a rod inserted in the sliding element.

* * * * *